United States Patent [19]

Lebet et al.

[11] 4,199,930

[45] Apr. 29, 1980

[54] ALARM SWITCH FOR AN ALARM CIRCUIT IN A HOROLOGICAL DEVICE

[75] Inventors: Jean-Philippe Lebet, Les Geneveys-sur-Coffrane; Jean-Claude Droz, Neuchatel, both of Switzerland

[73] Assignee: The Gillette Company, Boston, Mass.

[21] Appl. No.: 870,786

[22] Filed: Jan. 19, 1978

[51] Int. Cl.[2] ..... G04C 21/16

[52] U.S. Cl. ..... 368/252; 368/259; 368/322

[58] Field of Search ..... 58/23 D, 21.1, 22.5, 58/57.5, 139, 140 R, 152 B, 21, 19 R, 19 A

[56] References Cited

U.S. PATENT DOCUMENTS 3,686,879 8/1972 Hummel ..... 58/19 R

*Primary Examiner*—J. V. Truhe
*Assistant Examiner*—Leonard W. Pojunas, Jr.
*Attorney, Agent, or Firm*—Richard A. Wise; Donald E. Mahoney

[57] ABSTRACT

A horological device is provided with an alarm switch in the form of an alarm wheel having a conductive path extending from a topside of the wheel to a bottom side of the wheel. The alarm wheel is adapted to operate in an alarm circuit arranged to generate audible signals at a predetermined time. An alarm setting pinion is engaged with the alarm switch to prevent undesired movement of the alarm wheel in case of mechanical shock.

5 Claims, 6 Drawing Figures

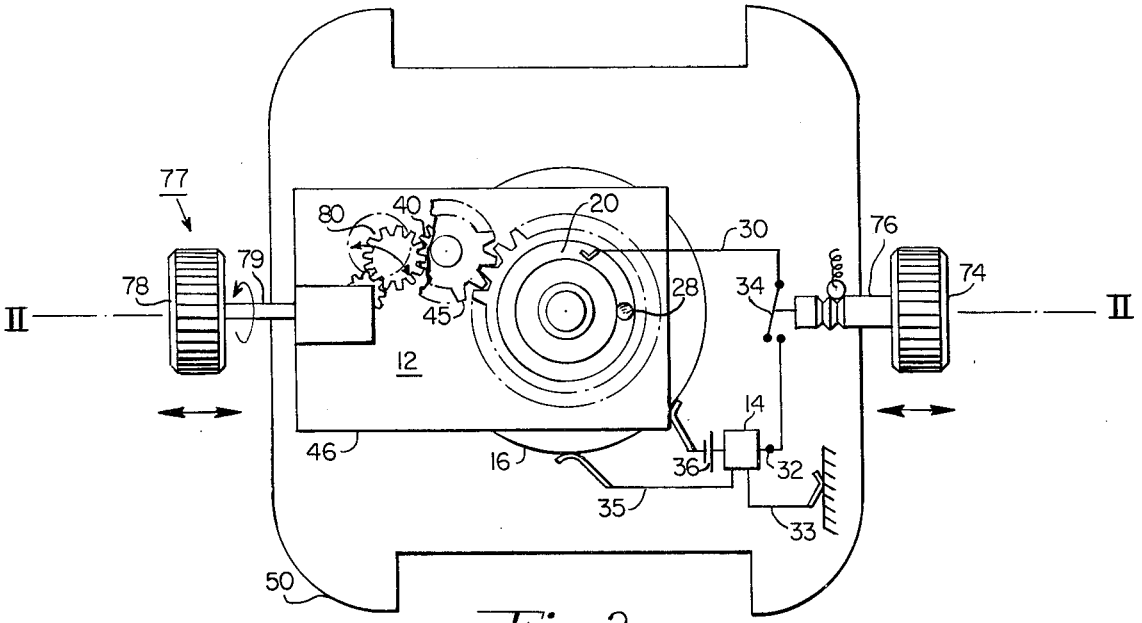
Fig. 2
Fig. 4
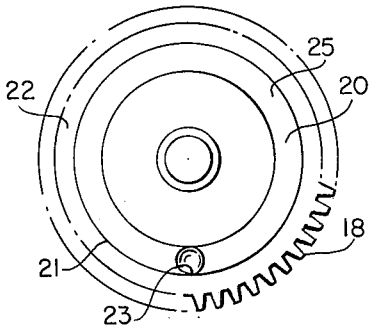
Fig. 5
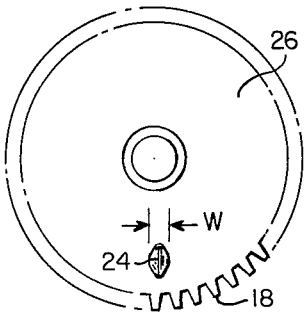
Fig. 6
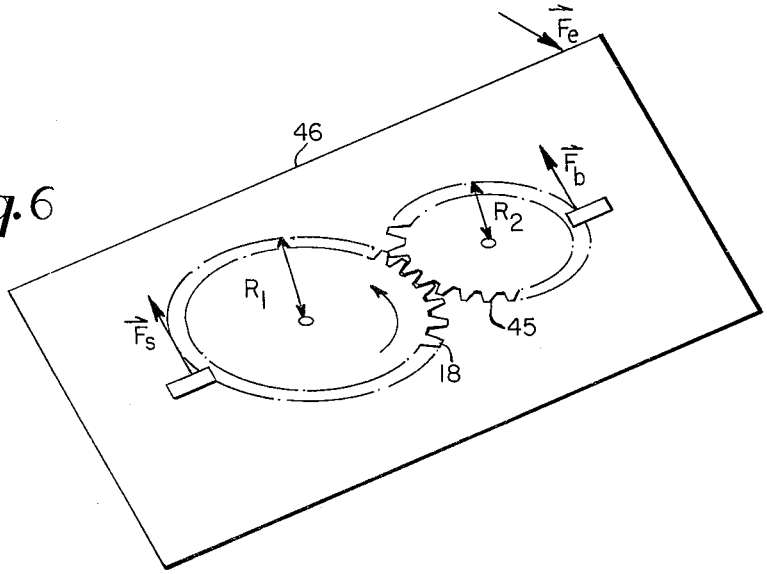

ALARM SWITCH FOR AN ALARM CIRCUIT IN A HOROLOGICAL DEVICE

BACKGROUND OF THE INVENTION

1. FIELD OF THE INVENTION

This invention relates to an alarm circuit in a horological device and, more particularly, to a novel alarm switch for operating the alarm circuit.

2. DESCRIPTION OF THE PRIOR ART

Alarm clocks and wristwatches having an alarm circuit for generating an audible alarm signal at a predetermined time are well known in the prior art. Relatively large dimensioned and cumbersome mechanisms employing cams or mandrels for actuating or adjusting switch contacts are generally used in a switch assembly for the alarm circuit. An attempt to simplify and provide an alarm circuit construction of small dimensions is described in U.S. Pat. No. 3,774,967 entitled "Watch With Adjustable Time-Dependent Signal Transmission," issued to Paolo Spadini on Dec. 4, 1973. Contact arms on an hour recording wheel and an adjustment indicator engage selected conductive surfaces on an integrated circuit arranged to activate a signal generator at a very large number of signal time points. It is understood that the integrated circuit could dissipate energy from a power source, such as a battery, even when the signal generator is not activated. Thus, it is desirable to provide a switch assembly construction of small dimensions that will conserve electrical energy until the signal generator is activated at a predetermined time.

U.S. Pat. No. 3,611,702 entitled "Electric Alarm Timepiece" issued to Paolo Spadini on Oct. 12, 1971 describes an electric switch including a first switch contact mounted to turn with an hour wheel. A second switch contact is included in a contact wheel comprising two parts; a metal hub and an electrically insulating plastic disc which partly covers an annular lip of the hub. The hour wheel and contact wheel are coaxially mounted on a cannon-pinion pipe so that the first switch contact on the hour wheel may slide over the plastic disc to eventually touch the second switch contact at a predetermined time.

The design and construction of switches of this kind for horological devices require a relatively thick alarm or contact wheel which could be susceptible to angular displacement when subjected to mechanical shock and vibration. Accordingly it is desirable to provide a switch assembly including a relatively thin alarm wheel that is easily fabricated and less susceptible to mechanical shock and vibration than prior art electric switches.

SUMMARY OF THE INVENTION

According to the present invention, a horological device of the type having a drive mechanism for moving a timing gear, and a source of electrical energy with a first terminal coupled to a first input terminal of an electronic drive circuit arranged to operate an electro-acoustical transmitting system to provide an audible signal at a predetermined time is improved by electrically connecting a second terminal of the electrical energy source to the timing gear. An electrical contact of switching means is attached to the timing gear and frictionally engaged with a first side of an alarm gear having substantially coplanar conductive and non-conductive surfaces thereon. The conductive surface on the alarm gear first side is electrically connected to a conductive surface on a second side of the alarm gear. Means are provided for electrically connecting the conductive surface on the alarm gear second side to a second input terminal of the electronic drive circuit, whereby the switching means provides a current conducting path from the second terminal of the electrical energy source to the second input terminal of the electronic drive circuit when the timing gear moves the electrical contact against the conductive surface on the first side of the alarm gear. An alarm setting pinion is engaged with the alarm gear and biased to prevent undesired angular movement of the alarm gear.

BRIEF DESCRIPTION OF THE DRAWING

These and other features and advantages of the invention will be better understood from a consideration of the following specification taken in conjunction with the accompanying drawing in which:

FIG. 2 is a top plan view of an alarm wristwatch with a dial and watch hands removed to show an alarm circuit and an alarm switch;

FIGS. 4 and 5 are top and bottom views, respectively, of the alarm gear; and

FIG. 6 is a schematic diagram illustrating the various forces that tend to act on the alarm gear if the wristwatch of FIG. 2 is subjected to an external force or vibration.

DESCRIPTION OF THE PREFERRED EMBODIMENT

Figure 1:
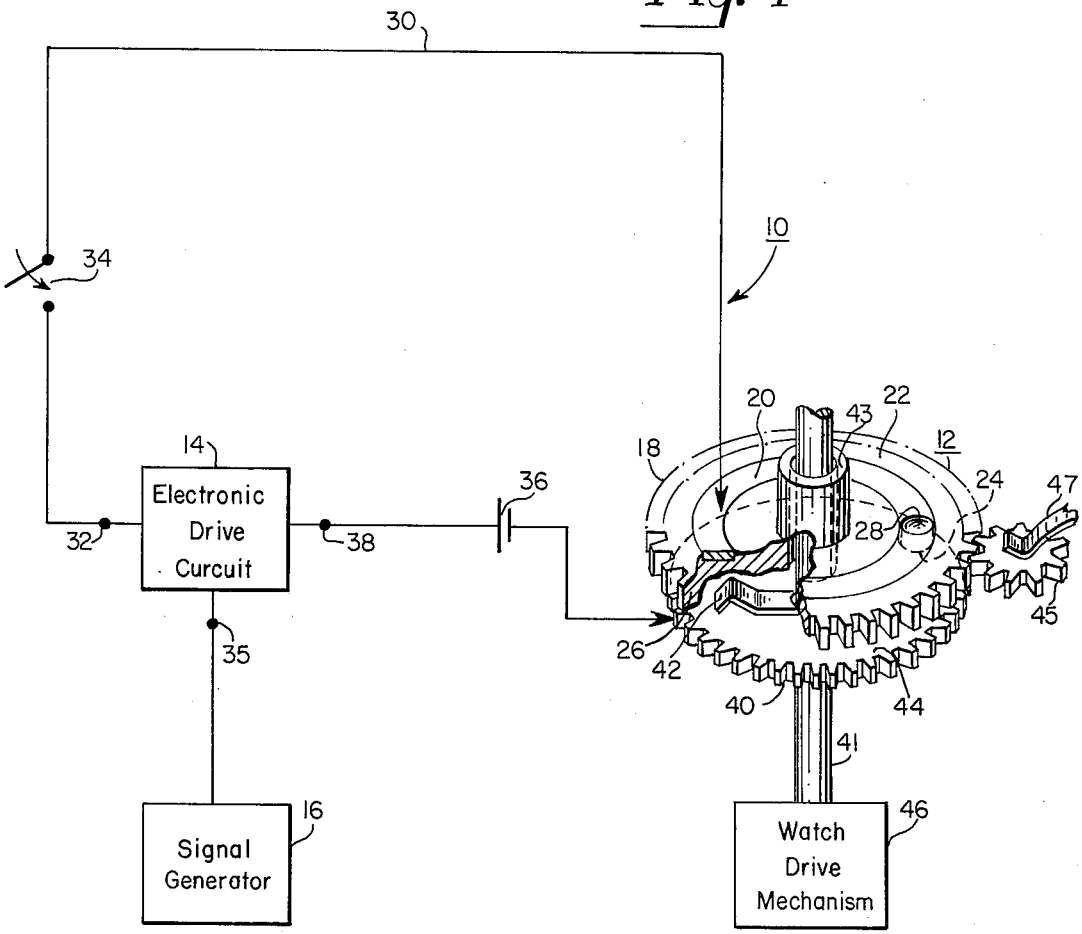
FIG. 1 is a simplified block diagram of a horological device arranged according to the invention.

Referring to FIG. 1, there is shown a block diagram of an alarm assembly 10 including a novel alarm switch 12 arranged to activate an alarm circuit including an electronic drive circuit 14 and an audible signal generator 16, to provide an audible alarm signal at a predetermined time. In the preferred embodiment, the alarm switch 12 is in the form of an alarm wheel 18 or gear having all surfaces coated with electrically insulating material except for a continuous conductive surface 20 substantially coplanar with the surface of a top side 22 of the alarm wheel 18 and a relatively narrow radial conductive strip 24 forming a contact segment substantially coplanar with the surface of a bottom side 26 of the alarm wheel 18.

A conductive path 28 electrically connects the conductive surface 20 on the top side 22 to the conductive surface 24 on the bottom side 26 of the alarm wheel 18. The conductive surface 20 on the alarm wheel top side 22 is electrically connected by a conductive path 30 to a first input terminal 32 of the electronic drive circuit 14 via a manually operated switch 34 in a closed position. An output terminal 35 of the electronic drive circuit 14 is electrically connected to the audible signal generator 16. The electronic drive circuit 14 is arranged, as known in the art, to operate the audible signal generator 16 or transmitter in response to an electrical input signal. The audible signal generator 16 may be of the type described in Swiss Pat. No. 497,760.

An electrical energy source, such as a battery 36, for providing the input signals to the electronic drive circuit 14, is serially connected between a second input terminal 38 of the electronic drive circuit 14 and a conductive timing gear 40, such as an hour recording wheel in a watch. The alarm wheel 18 and timing gear 40 are coaxially mounted on a drive shaft 41 extending from a drive mechanism, such as a watch drive mechanism 46, so that the timing gear 40 may angularly move independent of the alarm wheel 18. The alarm wheel hub 43 is arranged to be electrically insulated from the shaft 41. For example, the hub 43 may be coated with electrically insulating material. The battery 36 provides the input signal to the electronic drive circuit 14 when a current conducting path is completed between the battery 36 and the first input terminal 32 of the electronic drive circuit 14 via the alarm wheel 18 and timing wheel 40.

A switch wiper contact 42 is attached to a top side 44 of the watch timing gear 40 so as to frictionally engage the bottom side 26 of the alarm wheel 18. The watch timing gear 40 is rotated by the watch drive mechanism 46 while the alarm wheel 18 remains motionless. The wiper contact 42 is wipingly moved across insulated surface areas on the bottom side 26 of the alarm wheel 18 until, at a predetermined time, the switch wiper contact 42 is moved against the conducting surface or contact segment 24 on the bottom side 26 of the alarm wheel 18. A current conducting path between the battery 36 and the first input terminal 32 of the electronic drive circuit 14, including conductive surfaces 20 and 24, is completed and the audible signal generator 16 is caused to generate an audible alarm signal.

An alarm setting pinion 45 is engaged with the alarm wheel 18 and biased by a resilient member 47 to provide a braking function to prevent any undesirable rotational movement of the alarm wheel 18 due to a mechanical shock or vibration caused by dropping the switch assembly 10. As an example, the resilient member 47 may be a "neoprene" cylinder disposed between a watch dial 56 and a hole in the alarm setting pinion 45 to provide sufficient bias force to hold the alarm setting pinion 45 and the alarm wheel 18 in place, substantially without angular displacement, if the switch assembly 10 is dropped. The braking function of the alarm setting pinion 45 is further described below.

Figure 3:
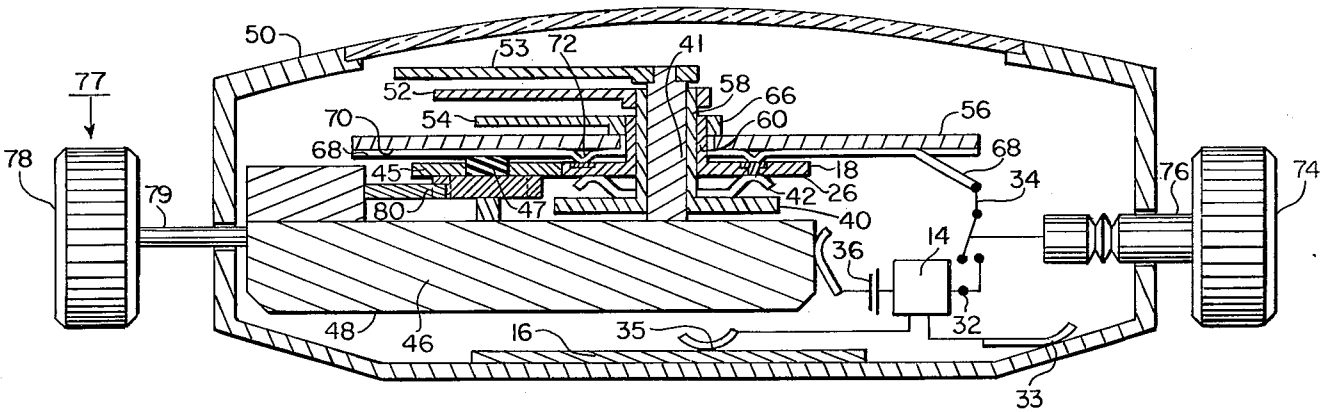
FIG. 3 is a cross sectional view of the watch depicted in FIG. 2 taken along line II—II and including the dial and watch hands.

Referring now to FIGS. 2 and 3, there is shown a plan view, and cross sectional view of a watch including the alarm circuit 14, 16 and the alarm switch 12 arranged according to the invention. A typical watch drive mechanism 46 or movement is assembled in a conductive housing 48 which, in turn, is assembled in a watch case 50. The conductive housing 48 of the watch movement 46 is electrically insulated from the watch case 50. The watch movement 46 may be arranged, as known in the art, to rotate timing wheels or gears, like hour wheel 40, over an angle of 360° at the end of a predetermined time period. Watch hands 52, 54 are arranged above the dial 56 and connected to respective hubs 58, 60 of the hour and alarm wheels 40, 18 protruding through a hole 66 in the dial 56. The watch hands 52, 53 are located above the dial 56 to indicate time by their positions relative to each other and graduations not shown on the dial 56. For example, the watch hand 52 is intended to indicate hours and is connected to the hour recording wheel hub 58 mounted on the minute drive shaft 41. The watch hand 53 is intended to indicate minutes and is connected to the minute drive shaft 41 associated with a minute recording wheel, not shown, in a manner well known in the prior art.

The hour wheel 40 is fabricated from conductive material and assembled on the minute drive shaft 41 so as to be in electrical contact with the conductive housing 48 of the watch movement 46. The alarm switch wiper contact 42 is electrically connected to the hour wheel 40 and biased or bent to frictionally engage the bottom side 26 of the alarm wheel 18 and contact the conductive surface 24 as described above. The wiper contact 42 may be an independent resilient arm mounted on the hour wheel 40 as described in U.S. Pat. No. 3,611,702.

The alarm wheel 18 is coaxially assembled on the hour wheel hub 58 so that a free end of the switch wiper contact 42 frictionally engages the bottom side 26 of the alarm wheel 18. To simplify manufacture and assembly, the alarm wheel hub 60 is arranged to be contiguous with the hour wheel hub 58 but the alarm wheel 18 and hour wheel 40 are free to rotate independent of each other. The alarm wheel 18 is electrically insulated from the hour wheel 40 and the watch movement 46 except when the switch wiper contact 42 is rotated by the watch movement 46 against the relatively small contact segment 24 on the bottom side 26 of the alarm wheel 18. For example, means for electrically insulating the alarm wheel 18 from the hour wheel 40 include anodizing or coating all surface areas of an aluminum alarm wheel 18 or gear, including an inside surface of the alarm wheel hub 60, with a protective film of insulating material such as aluminum oxide.

Referring to FIGS. 4 and 5, there is shown top and bottom views of the alarm gear 18. The top side 22 of the anodized aluminum alarm wheel 18 is provided with a circular groove 21 and a through hole 23 in the groove 21. A thin conductive ring 25 is pressed into the hole 23 and groove 21 to provide a continuous conductive surface 20 substantially coplanar with the top side 22 of the alarm wheel 18. A portion of the conductive ring 25 is forced through the hole 23 to form the contact segment 24 substantially coplanar with the bottom side 26 of the alarm gear 18. The width, w, of the contact segment 24 determines the duration of the alarm signal.

Referring back to FIGS. 2 and 3, there is shown a conductive foil 68 or sheet attached to a bottom side 70 of the dial 56. The foil 68 includes a ring shaped resilient contact 72 or dimple adapted to provide an electrical connection with the alarm gear 18 when the contact 72 is pressed against the conductive ring 25 on the top side 22 of the alarm wheel 18 during assembly.

If desired, a suitable, manually operated ON/OFF switch 34 may be electrically connected in series between the foil 68 and the first input terminal 32 of the electronic drive circuit 14 for disconnecting the alarm circuit 14, 16 from the battery 36. The ON/OFF switch 34 may be operated by pushing or pulling a knob 74 attached to a stem 76 in a manner well known in the prior art. A small disc type battery 36 commonly used in hearing aids and electronic watches is electrically connected in series between the second input terminal 36 of the electronic drive circuit and the hour wheel 40 via the conductive housing 46 of the watch movement 48. The electronic drive circuit 14 has a first output terminal 33 electrically connected to the watch case 50 and a second output terminal 35 electrically connected to the signal generator 16 which could include a piezoelectric crystal or electroacoustic transducer coupled to a membrane attached to the watch case 50.

The alarm setting pinion 45 may be coupled to a prior art three position actuating stem assembly 77 including a knob 78 extending from the watch case 50 and typically used to selectively change time, day/date or be moved to a neutral/winding position. The actuating stem assembly 77 includes a stem 79 electrically insulated from the casing 50 and a complex arrangement of gears or pinions which can be selectively moved into one of three positions; namely, a time setting position, an alarm setting position, and a neutral position. Under operating conditions, the time setting position is attained with a user would push or pull the knob 78 until a gear 80 on the actuating stem assembly 77 is engaged with the hour wheel 40. The actuating stem 79 and hour wheel 40 are rotatably moved when the knob 78 is rotated. Thus, when the actuating stem assembly 77 is in the time setting position, the hour and minute hands 52, 53 may be rotated to a desired position.

The alarm setting position is attained when the knob 78 is pushed or pulled until gear 80 on the actuating stem assembly 77 meshes with the alarm setting pinion 45. The knob 78 is then rotated to cause rotation of the alarm setting pinion 45, the alarm gear 18 and an alarm indicating hand 54 attached to the hub 60 of the alarm gear 18. As an example, the alarm indicating hand 54 may extend radially from the alarm gear hub 60 substantially over the contact segment 24 on the bottom side 26 of the alarm gear 18 and the hour indicating hand 52 may extend radially from the hour wheel hub 58 substantially over the contact 42 on the hour wheel 40. Thus, by observing the position of the alarm indicating hand 54 on the dial 56, a user would be able to set the time at which the alarm contact 42 on the hour wheel 40 would electrically contact the conductive surface 24 on the bottom side 26 of the alarm wheel 18.

The knob 78 may be pushed or pulled until the actuating stem assembly 77 is in a neutral position and actuating stem assembly gear 80 is not engaged with either the hour wheel 40 of the alarm wheel 18.

Referring to FIG. 6 there is shown schematically some of the various forces that tend to act on the alarm switch including the braking force, $F_b$, applied to the alarm pinion 45 via the resilient member 47 and the frictional force, $F_s$, provided by the frictional contact between the alarm wheel 18 and the alarm wheel pinion 45. If the alarm switch assembly 10 and watch movement 46 are subjected to an external force or vibration, $F_e$, that tends to rotate the watch movement 46, torques are induced on the alarm wheel 18 and pinion 45 that could cause an angular displacement of the alarm wheel 18 from a preferred position and, thus a spurious alarm signal at an undesired time. It is thought that angular displacement of the alarm wheel 18 can be minimized if angular acceleration of the alarm wheel 18 is minimized. It has been determined that by meshing the alarm wheel 18 with the alarm pinion 45, as discussed above, the angular acceleration, $\dot{w}_1$, of the alarm wheel 18 with respect to the watch movement 46 is:

$$\dot{w}_1 = \frac{-\dot{w}\left[\theta_1 - \theta_2\left(\frac{R_1}{R_2}\right)\right] + T_1 + T_2\left(\frac{R_1}{R_2}\right)}{\theta_1 + \theta_2\left(\frac{R_1}{R_2}\right)^2}$$

where $\dot{w}$ is the angular acceleration of the watch movement 46 caused by the external force $\vec{F}_e$, $\theta_1$ is the inertial moment of the alarm wheel 18, and $\theta_2$ is the inertial moment of the alarm pinion 45. $T_1$ is the frictional torque resulting from the frictional forces, $\vec{F}_s$, being applied against alarm wheel 18. $T_2$ is the frictional torque resulting from the braking forces, $\vec{F}_b$, being applied against the alarm pinion 45 via resilient member 47. $R_1$ is the radius of the alarm wheel 18 and $R_2$ is the radius of the alarm pinion 45. Thus, the angular displacement and angular acceleration, $\dot{w}_1$, of the alarm wheel 18 can be decreased in inverse proportion to the ratio $(R_1/R_2)^2$. In other words, by arranging a small diameter alarm pinion 45 to mesh with a larger diameter alarm gear 18, a mechanical advantage is attained that tends to minimize angular displacement of the alarm gear 18 when the alarm switch assembly 10 and watch movement 46 is acted on by the external force $\vec{F}_e$. In addition, the braking force, $\vec{F}_b$, applied to the alarm gear 18 is enhanced by arranging the alarm pinion 45 to be frictionally engaged with the dial 56 via resilient member 47 instead of frictionally coupling a surface of the alarm gear 18 to the dial 56 as known in the prior art.

An example of a novel alarm switch assembly for a watch or clock assembly has been shown and described. Numerous and varied other arrangements can readily be devised in accordance with the disclosed principles.

What is claimed is:

1. In a horological device of the type having a drive mechanism for moving a timing gear and an attached indicator across a dial, and a source of electrical energy with a first terminal coupled to a first input terminal of an electronic drive circuit arranged to operate an electroacoustical transmitting system to provide an audible signal at a predetermined time, the improvement comprising:

said electrical energy source having a second terminal electrically connected to said timing gear;

an alarm gear having a first side and a second side;

switching means having an electrical contact electrically connected to said timing gear and arranged to move with said timing gear, said electrical contact being frictionally engaged with said first side of said alarm gear mounted coaxially with said timing gear with an insulated surface contiguous with conductive and non-conductive surfaces thereon, said conductive surface on said alarm gear first side being electrically connected to a conductive surface on said second side of said alarm gear;

means for electrically connecting said conductive surface on said alarm gear second side to a second input terminal of said electronic drive circuit, whereby said switching means provides a current conducting path from said second terminal of said electrical energy source to said second input terminal of said electronic drive circuit when said timing gear moves said electrical contact against said conductive surface on said first side of said alarm gear; and an alarm setting pinion engaged with said alarm gear and biased to keep said alarm gear substantially motionless and prevent undesired rotational displacement of said alarm gear from a fixed position when said electrical contact on said timing gear is moved against said first side of said alarm gear.

2. A horological device according to claim 1, wherein said alarm gear includes an anodized aluminum gear having a planar first side and an opposite planar second side having conductive ring disposed within a circular groove in said second side and in aperture extending from said first side to said second side to form said substantially coplanar conductive surface on said first side.

3. A horological device according to claim 1, wherein said alarm setting pinion includes a cylinder of resilient material disposed between an opposing surface of said dial and a hole in said alarm setting pinion for providing said bias to prevent said undesired rotational movement of said alarm gear.

4. A horological device according to claim 1, wherein said conductive surface on said first side is a radial conductive strip having a predetermined width, W, proportional to the duration of said audible signal.

5. A horological device according to claim 1, wherein said alarm gear is engaged with a smaller diameter alarm setting pinion to provide a mechanical advantage to prevent said undesired rotational displacement of said alarm gear from said fixed position.

* * * * *